US010448721B1

(12) United States Patent
Love

(10) Patent No.: US 10,448,721 B1
(45) Date of Patent: Oct. 22, 2019

(54) HAIRSTYLING CAP

(71) Applicant: Ashley Love, Nashville, TN (US)

(72) Inventor: Ashley Love, Nashville, TN (US)

( * ) Notice: Subject to any disclaimer, the term of this patent is extended or adjusted under 35 U.S.C. 154(b) by 366 days.

(21) Appl. No.: 15/152,356

(22) Filed: May 11, 2016

(51) Int. Cl.
*A45D 1/02* (2006.01)
*A45D 2/46* (2006.01)
*A45D 2/02* (2006.01)

(52) U.S. Cl.
CPC ..... *A45D 2/46* (2013.01); *A45D 2/02* (2013.01); *A45D 2002/025* (2013.01)

(58) Field of Classification Search
CPC ..... A45D 2/46; A45D 2/02; A45D 2002/025; A45D 2/00; A45D 2002/003; A45D 2/38
See application file for complete search history.

(56) References Cited

U.S. PATENT DOCUMENTS 2,134,878 A * 11/1938 La Fortune ..... A45D 2/46 132/128
2,285,144 A * 6/1942 Bregou ..... A45D 2/46 132/223
2,309,638 A * 2/1943 Fink ..... A45D 2/46 132/223
2,775,973 A * 1/1957 McDonough ..... A45D 2/46 132/274
3,109,438 A * 11/1963 Work ..... A45D 2/46 132/222
3,320,682 A * 5/1967 Sliman ..... A45D 2/46 126/204
3,327,720 A 6/1967 Carmony et al.
3,556,115 A 1/1971 Benson
3,561,455 A 2/1971 Gregg
4,605,017 A * 8/1986 Thompson ..... A45D 19/18 132/333
4,683,596 A 8/1987 Cole
D357,792 S 5/1995 Cromer
D364,495 S 11/1995 Smith
5,477,561 A 12/1995 Adkins
5,950,636 A * 9/1999 Hickey ..... A45D 2/46 132/200
D720,120 S 12/2014 Simmonds
2004/0040066 A1* 3/2004 Hardenbrook ..... A42B 1/041 2/171
2004/0221369 A1* 11/2004 Takanohashi ..... A42B 1/041 2/171
2017/0172272 A1* 6/2017 Gonzales ..... A45D 2/00

* cited by examiner

*Primary Examiner* — Nicholas D Lucchesi

(57) ABSTRACT

A hairstyling cap devised to achieve a beach wave hairstyle without the use of a curling iron or flat iron or the application of a permanent wave solution to the hair by providing a flexible cap body and flexible spiral hairstyling rods insertable within the cap body and interconnected by drawstrings disposed through a longitudinal conduit of each hairstyling rod. As the drawstrings are pulled away from the cap body through respective apertures in a casing and are secured together, the hairstyling rods, attached to the wearer's hair strands, collapse condition to "scrunch" the wearer's hair for a beach wave hairstyle.

4 Claims, 4 Drawing Sheets

HAIRSTYLING CAP

BACKGROUND OF THE INVENTION

Various types of coiffure protection caps are known in the prior art. However, what is needed is a hairstyling cap including.

FIELD OF THE INVENTION

The present invention relates to hairstyle maintenance caps, and more particularly, to a hairstyling cap in which spiral rods interconnected with drawstrings are inserted after rolling the wearer's hair onto the spiral rods so that when the drawstring are pulled, the wearer's hair is scrunched to achieve a waved hairstyle.

SUMMARY OF THE INVENTION

The general purpose of the present hairstyling cap, described subsequently in greater detail, is to provide a hairstyling cap which has many novel features that result in a hairstyling cap which is not anticipated, rendered obvious, suggested, or even implied by prior art, either alone or in combination thereof. To accomplish this, the present hairstyling cap is devised to achieve a waved hairstyle, such as a beach wave hairstyle, and without the use of a curling iron or flat iron or the application of a permanent wave solution to the hair by providing a flexible cap body having an access opening into a cavity thereof, a casing continuously disposed along the access opening, and a pair of first apertures diametrically disposed through the casing from a pair of second apertures disposed through the casing.

A plurality of spaced apart longitudinally flexible hollow interconnected spiral hairstyling rods, which are rolled onto the wearer's hair strands, is insertable within the cavity of the cap body and includes a forward rod group, a rearward rod group, and a central rod group. Each of the hairstyling rods has a continuous longitudinal conduit therethrough for receiving one of a first drawstring which interconnects the forward rod group and a portion of the central rod group and a second drawstring which interconnects the rearward rod group and a portion of the central rod group. As each of a first end of each of the first and second drawstrings and a second end of each of the first and second drawstrings is pulled away from the cap body through the respective one of the first apertures and the second apertures and secured together, the hairstyling rods, attached to the wearer's hair strands, are transformed from an extended condition to a collapsed condition to "scrunch" the wearer's hair to form the beach wave hairstyle and to secure the casing against the contour of the face and neck of the wearer. The cap body can be worn overnight so that the hairstyle is ready the next morning. The casing is elastomeric. The cap body can be formed of silk or satin to assist in preserving the hairstyle achieved by wearing the cap body and in preventing tangling and breakage of the hair. In addition, a satin pillowcase assists in keeping the wearer's hair in a healthy condition by preserving the natural moisture of the wearer's hair.

The hairstyling rods are provided in a range of lengths from short to long to accommodate the hair length of the wearer. The hairstyling rods are also provided in a range of diameters to achieve a range of curl tightness from loose to tight. The present device can be worn overnight to create a hairstyle, such as a beach wave hairstyle, without the use of a curling iron or flat iron or the application of a permanent wave solution and, therefore, protects the hair against heat damage that can occur with the use of curling iron or flat iron and against hair breakage that can occur with the application of a permanent wave solution. Thus has been broadly outlined the more important features of the present hairstyling cap so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
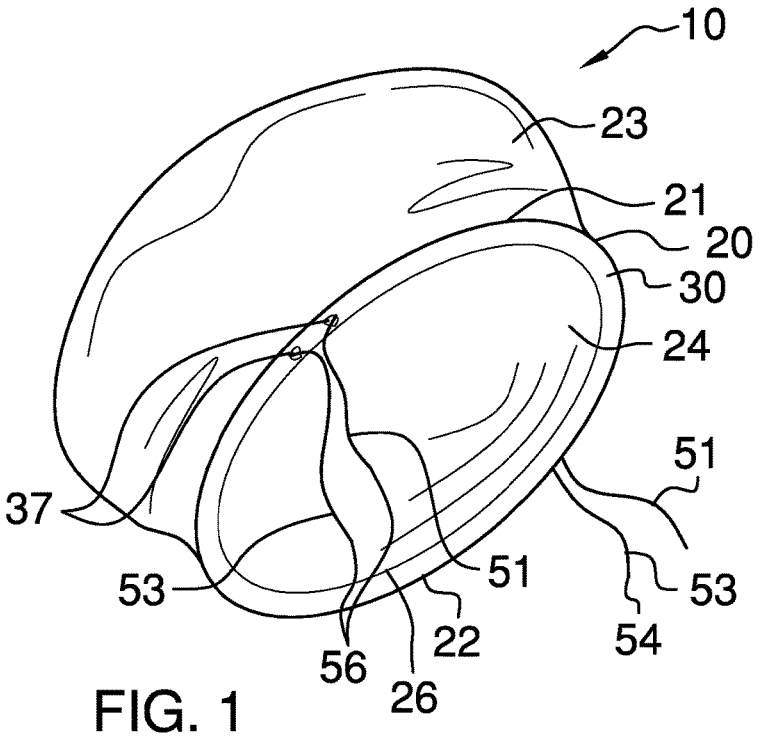
FIG. 1 is an isometric view.
Figure 2:
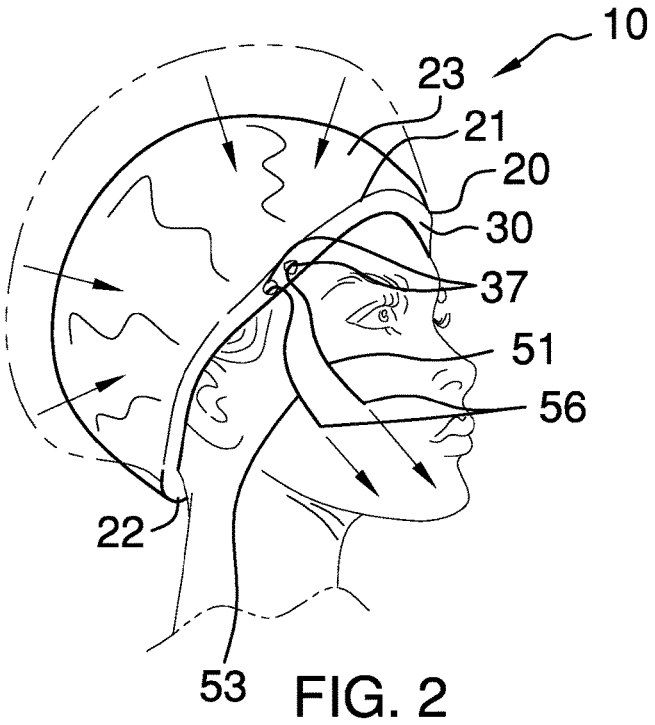
FIG. 2 is an in-use view.
Figure 3:
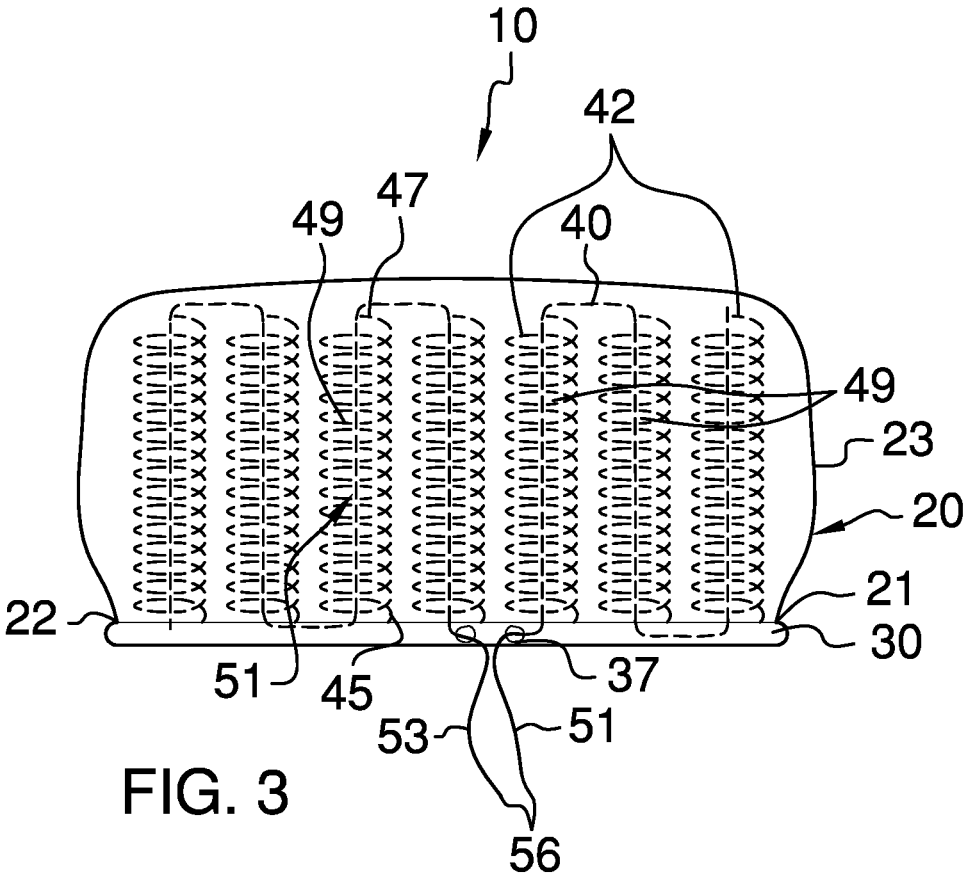
FIG. 3 is a side elevation view.
Figure 4:
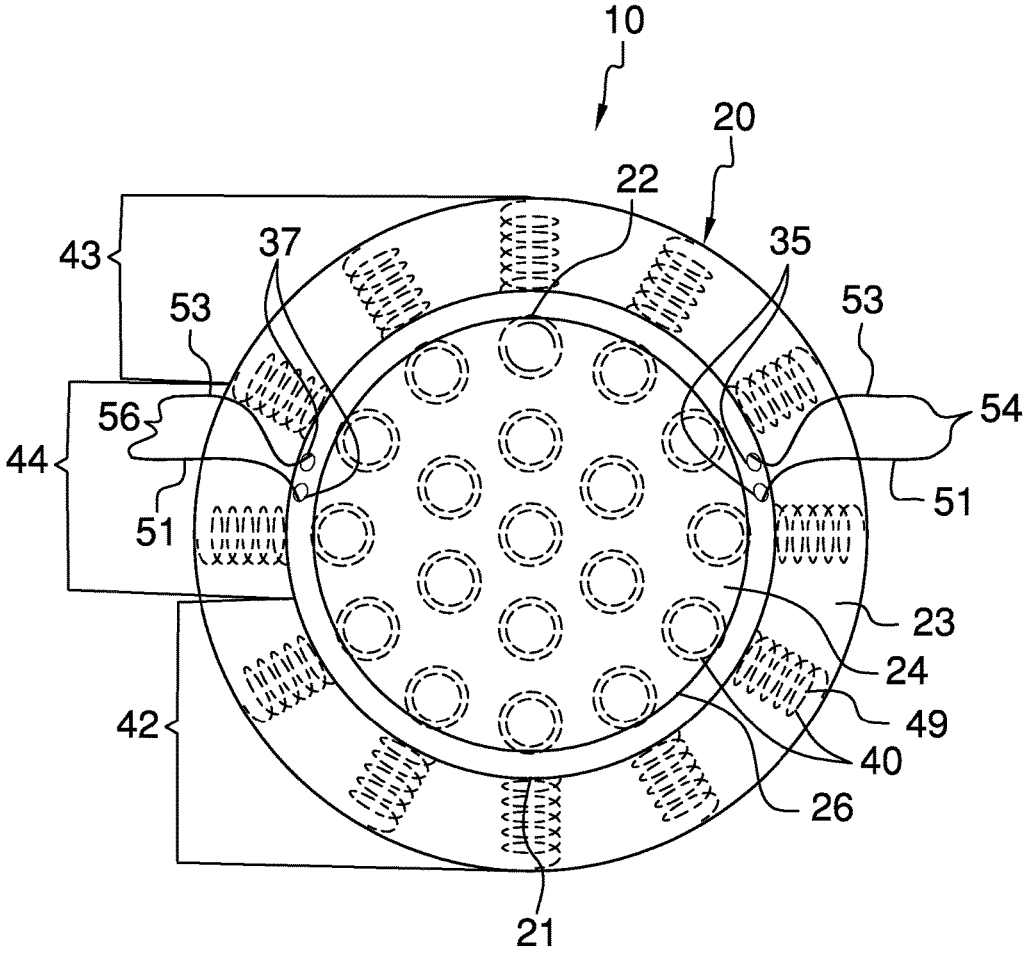
FIG. 4 is a bottom view.
Figure 5:
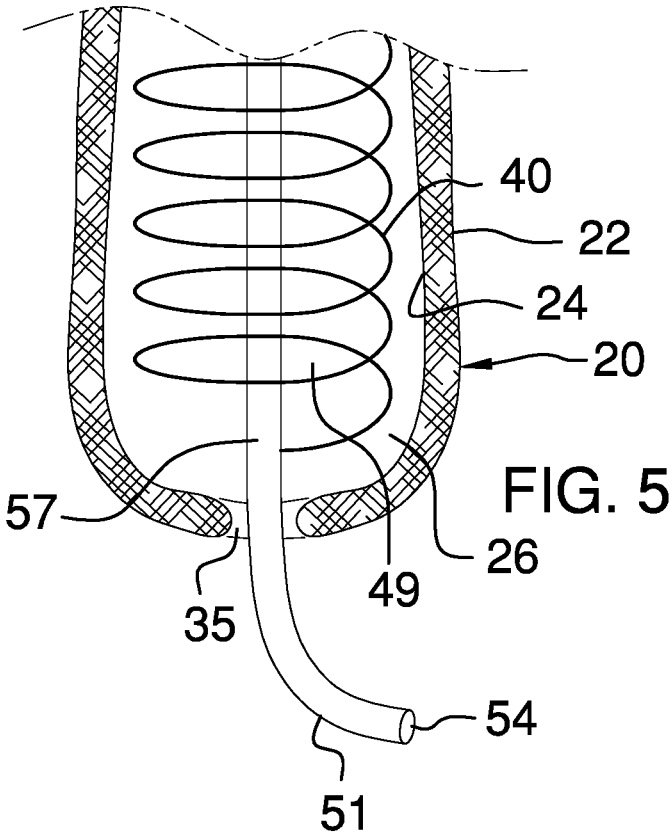
FIG. 5 is a detail view of a spiral rod within a cap body and a drawstring disposed with a conduit of the spiral rod.

With reference now to the drawings, and in particular FIGS. 1 through 5 thereof, an example of the instant hairstyling cap employing the principles and concepts of the present hairstyling cap and generally designated by the reference number 10 will be described.

Referring to FIGS. 1 through 5 the present hairstyling cap 10, devised to achieve a wave hairstyle and without the use of a curling iron or flat iron or the application of a permanent wave solution to the hair, is illustrated. The hairstyling cap 10 includes a flexible cap body 20 having a front side 21, a rear side 22, an external wall 23, an internal wall 24, and a cavity 26 defined by the internal wall 24. The cap body 20 also has an access opening 28 into the cavity 26 and a casing 30 continuously disposed along the access opening 28. A pair of first apertures 35 is diametrically disposed through the casing 30 from a pair of second apertures 37 disposed through the casing 30.

A plurality of spaced apart longitudinally flexible hollow interconnected spiral hairstyling rods 40 is provided. The hairstyling rods 40 are used to roll up the wearer's hair strands. Once the wearer's hair is rolled onto the hairstyling rods 40, the cap body 20 is placed over the hairstyling rods, which are inserted within the cavity 26 of the cap body 20. The hairstyling rods 40 include a forward rod group 42, a rearward rod group 43 disposed more proximal the rear side 22 than the forward rod group 42, and a central rod group 44 disposed between the forward rod group 42 and the rearward rod group 43. Each of the hairstyling rods 40 has a proximal end 45, a distal end 47, and a continuous longitudinal conduit 49 between the proximal end 45 and the distal end 47. Each of the hairstyling rods 40 has an extended condition and an alternate collapsed condition.

A first drawstring 51 is provided to interconnect the forward rod group 42 and a portion of the central rod group 44. A second drawstring 53 is provided to interconnect the rearward rod group 43 and a portion of the central rod group 44. Each of the first drawstring 51 and the second drawstring 53 has a first end 54 extending from outside the cap body 20 proximal a respective one of the first apertures 35 and entering the cap body 20 through the respective one of the first apertures 35, a second end 56 exiting from the cap body 20 through the respective one of the second apertures 37, and a length 57 continuously disposed between the respective first end 53 and second end 56. The length 57 extends longitudinally through the conduit 49 of each the respective one of the forward rod group 42 and the respective portion of the central rod group 44 and the rearward rod group 43 and the respective portion of the central rod group 44 of the plurality of hairstyling rods 40. The first end 54 of each of the first drawstring 51 and the second drawstring 53 are engageable to each other. The second end 56 of the first drawstring 51 and the second drawstring 53 are engageable to each other.

When the wearer's hair strands are rolled onto the hairstyling rods and the cap body is placed upon the wearer's head over the hairstyling rods, by a pulling motion of the first end 54 of each of the first and second drawstrings 51, 53 and the second end 56 of each of the first and second drawstrings 51, 53 through the respective pair of first apertures 35 and pair of second apertures 37 away from the cap body 20, the first and second drawstrings 51, 53 are transformed from a relaxed condition to a gathered condition. Upon the gathering of the first and second drawstrings 51, 53 and the engagement of the first ends 54 together and the second ends 56 together, each of the forward rod group 42 and a portion of the central rod group 44 and the rearward rod group 43 and a portion of the central rod group 44 of the plurality of hairstyling rods 40, respectively, are transformed from the extended condition to the collapsed condition and the casing 30 is securingly disposed against the contour of the face and neck of a wearer.

The casing 30 is elastomeric. The cap body 20 can be formed of silk or satin to assist in preserving the hairstyle achieved by wearing the cap body 20 and in preventing tangling and breakage of the hair. In addition, a satin pillowcase assists in keeping the wearer's hair in a healthy condition by preserving the natural moisture of the wearer's hair.

The inventor claims:

1. A hairstyling cap comprising:

a flexible cap body having a front side, a rear side, an external wall, an internal wall, a cavity defined by the internal wall, an access opening into the cavity, and a casing continuously disposed along the access opening;

a pair of first apertures diametrically disposed through the casing from a pair of second apertures disposed through the casing;

a plurality of spaced apart longitudinally flexible hollow interconnected spiral hairstyling rods insertable into the cavity of the cap body, the hairstyling rods comprising a forward rod group, a rearward rod group more proximal the rear side than the forward rod group, and a central rod group between the forward rod group and the rearward rod group, each of the hairstyling rods having a proximal end, a distal end, and a continuous longitudinal conduit between the proximal end and the distal end, each of the hairstyling rods further having an extended condition and an alternate collapsed condition;

a first drawstring interconnecting the forward rod group and a portion of the central rod group, a second drawstring interconnecting the rearward rod group and a portion of the central rod group, each of the first drawstring and the second drawstring having a first end extending from outside the cap body proximal a respective one of the first apertures and entering the cap body through the respective one of the first apertures, a second end exiting from the cap body through a respective one of the second apertures, and a length continuously disposed between the respective first end and second end, the length extending longitudinally through the conduit of the forward rod group and the rearward rod group and the respective portion of the central rod group of the hairstyling rods, the first end of each of the first drawstring and the second drawstring being engageable to each other, the second end of each of the first drawstring and the second drawstring being engageable to each other;

wherein upon a pulling motion of each of the first end and the second end of each of the first drawstring and the second drawstring through the respective one of the first apertures and second apertures away from the cap body, the first and second drawstrings are transformed from a relaxed condition to a gathered condition; and wherein upon the gathering of the first and second drawstrings and the engagement of the first end of the first and second drawstrings to each other and the second end of the first and second drawstrings to each other, the hairstyling rods are transformed from the extended condition to the collapsed condition and the casing is securingly disposed against the contour of the face and neck of a wearer.

2. The hairstyling cap of claim 1 wherein the casing is elastomeric.

3. The hairstyling cap of claim 1 wherein the cap body is formed of silk.

4. The hairstyling cap of claim 1 wherein the cap body is formed of satin.

* * * * *